United States Patent [19]

Miner et al.

[11] Patent Number: 4,945,604

[45] Date of Patent: Aug. 7, 1990

[54] PORTABLE BLOWER

[75] Inventors: Jonathan L. Miner, Timonium; Vernon R. Lacher, Fallston; Gerald J. Rescigno, Baltimore, all of Md.; William B. Swim, Cookeville, Tenn.; Martin P. Gierke; David A. Hahn, both of Baltimore, Md.

[73] Assignee: Black & Decker Inc., Newark, Del.

[21] Appl. No.: 446,465

[22] Filed: Dec. 4, 1989

[51] Int. Cl.[5] ..... A47L 5/14; A47L 9/28

[52] U.S. Cl. ..... 15/344; 15/405; 15/410

[58] Field of Search ..... 15/344, 339, 410, 405

[56] References Cited

U.S. PATENT DOCUMENTS

| | | | |
|---|---|---|---|
| 3,999,243 | 12/1976 | LaPour | 15/405 X |
| 4,052,767 | 10/1977 | Dutcher | 15/410 X |
| 4,288,886 | 9/1981 | Siegler | 15/405 X |
| 4,318,203 | 3/1982 | Saton et al. | 15/405 X |
| 4,325,163 | 4/1982 | Mattson et al. | 15/405 X |

*Primary Examiner*—Chris K. Moore

*Attorney, Agent, or Firm*—Harness, Dickey & Pierce

[57] ABSTRACT

A portable rechargeable battery-operated slender tubular blower for removing relatively light debris from hard surfaces such as sidewalks, driveways, decks or workbench surfaces. The blower uses an axial flow blower fan arranged for noise minimization and energy efficient operation. Blower tube inlet and outlet portions are arranged debris removal effectiveness by optimizing airflow volume and velocity parameters.

20 Claims, 8 Drawing Sheets

PORTABLE BLOWER

This is a continuation of U.S. patent application Ser. No. 119,491, filed Nov. 12,1987, now U.S. Pat. No. 4,884,314, issued Dec. 5, 1989.

BACKGROUND OF THE INVENTION

The invention relates generally to blower apparatus for clearing various surfaces of debris. More specifically, the invention concerns lightweight, portable blowers utilizing axial fans and intended as replacements for conventional brooms or brushes.

Most conventional air blowers designed for use in clearing debris from a variety of work surfaces are either relatively heave devices powered by internal combustion engines or relatively inconvenient and expensive corded electrical appliances. The last decade has been the introduction of cordless, hand-held, lightweight household or vehicle power cleaning devices for supplementing the normal complement of corded, heavy-duty appliances, such as full-size vacuum cleaners, for a variety of lighter duty cleaning tasks. However, there remains a perceived absense of such cordless devices for lighter duty debris clearing functions presently performed by heavier duty powered blowers.

Various prior art blower designs have been proposed. Nevertheless, there remains a need to provide a lightweight, portable blower, preferably cordless, having a slender configuration with low noise, low vibration and energy efficient operation.

SUMMARY OF THE INVENTION

It is an object of the invention to fill the need for a lightweight, easy-to-use, portable blower for removing debris from a variety of work surfaces.

The invention contemplates portable blower apparatus having an elongate, tubular housing with inlet and outlet ends. A drive motor within the housing has a drive shaft extending substantially parallel to a longitudinal axis of the housing. Coupled to the drive shaft is at least one axially-directed fan arranged for moving air from the housing inlet to the housing outlet. Additionally, airflow directing and smoothing apparatus is positioned with respect to the drive motor and fan to maintain airflow substantially parallel to the longitudinal axis of the housing, and the fan is positioned at a predetermined distance from the housing inlet such that standing waves within the housing having predominate noise frequencies generated by the fan are prevented.

It is a feature of the invention that a portable blower is provided with improved airflow efficiencies enabling use of a battery-powered blower motor driving an axially-directed fan.

It is a further feature of the invention that it provides a lightweight blower held by the user in a normal walking position with the blower functioning in an ergonomic manner as a normal extension of the user's arm, with the outlet air of the blower being directed substantially parallel to the work surface.

It is a further feature of the invention that a blower designed in accordance therewith can be easily used by people of various heights.

It is still another feature of the invention that a blower is provided with effective airflow volume and speed, yet operates with a minimum of objectionable noise and vibration.

It is yet another feature of the invention that the appratus used within the blower to direct and smooth airflow generated by the fan blower is also used to support the drive motor within the blower housing.

BRIEF DESCRIPTION OF THE DRAWING

These and other objects and features of the invention will become apparent from a reading of a detailed description of a preferred embodiment and alternative arrangements taken in conjunction with the drawing, in which: .

Figure 15:
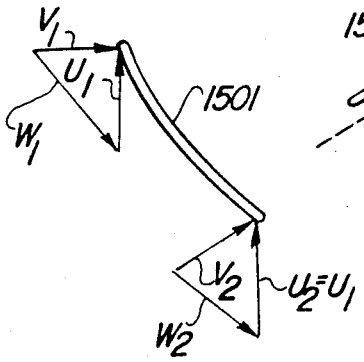
Figure 15:
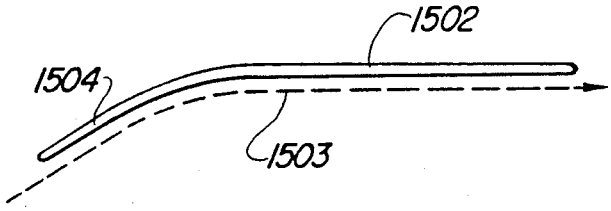
Figure 17:
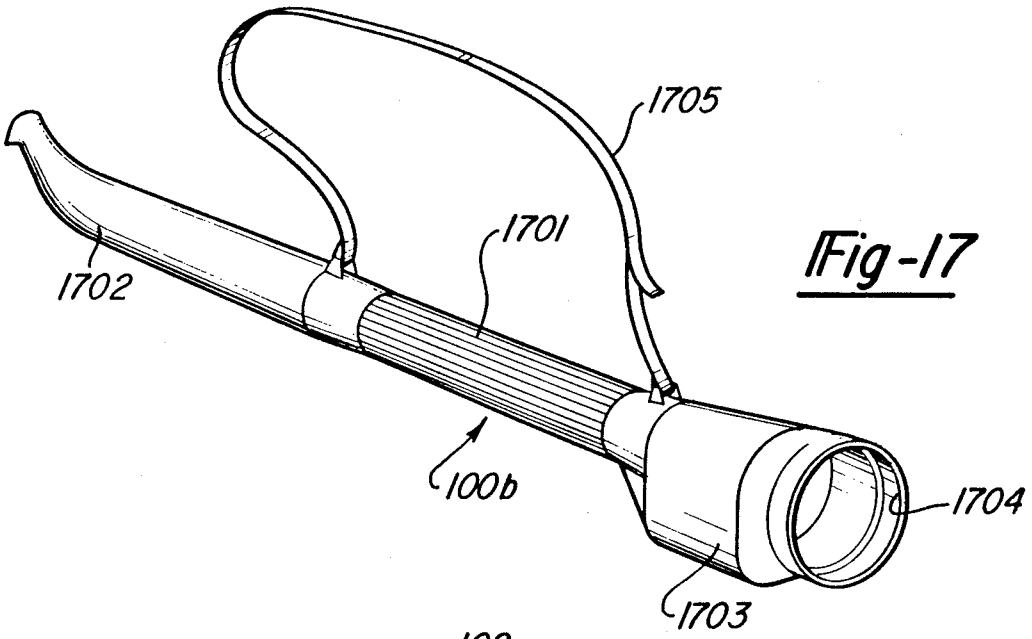
Figure 16:
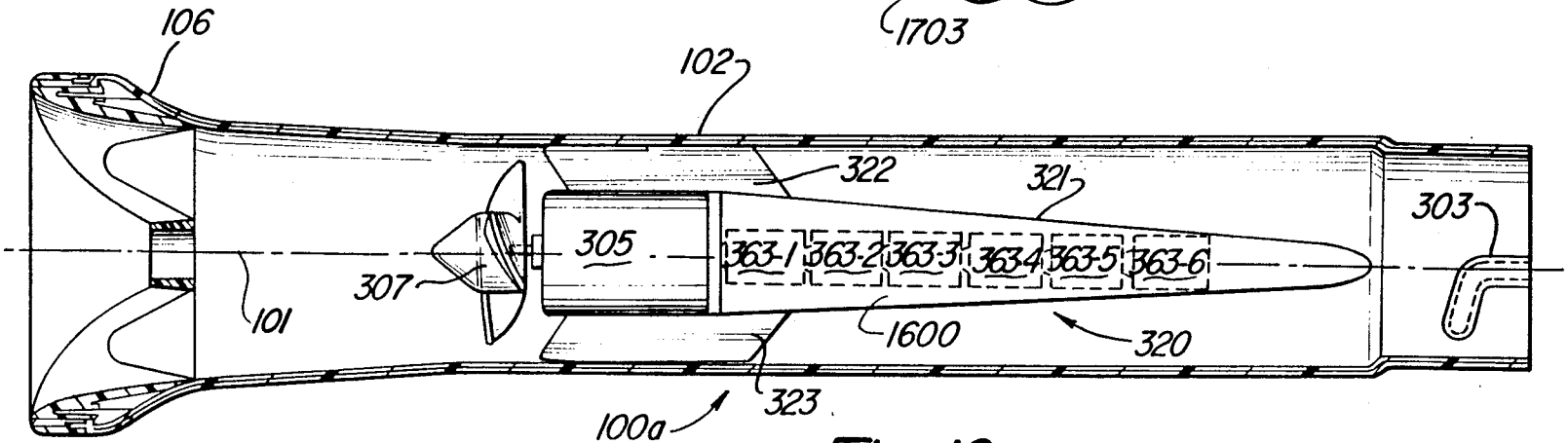
Figure 18:
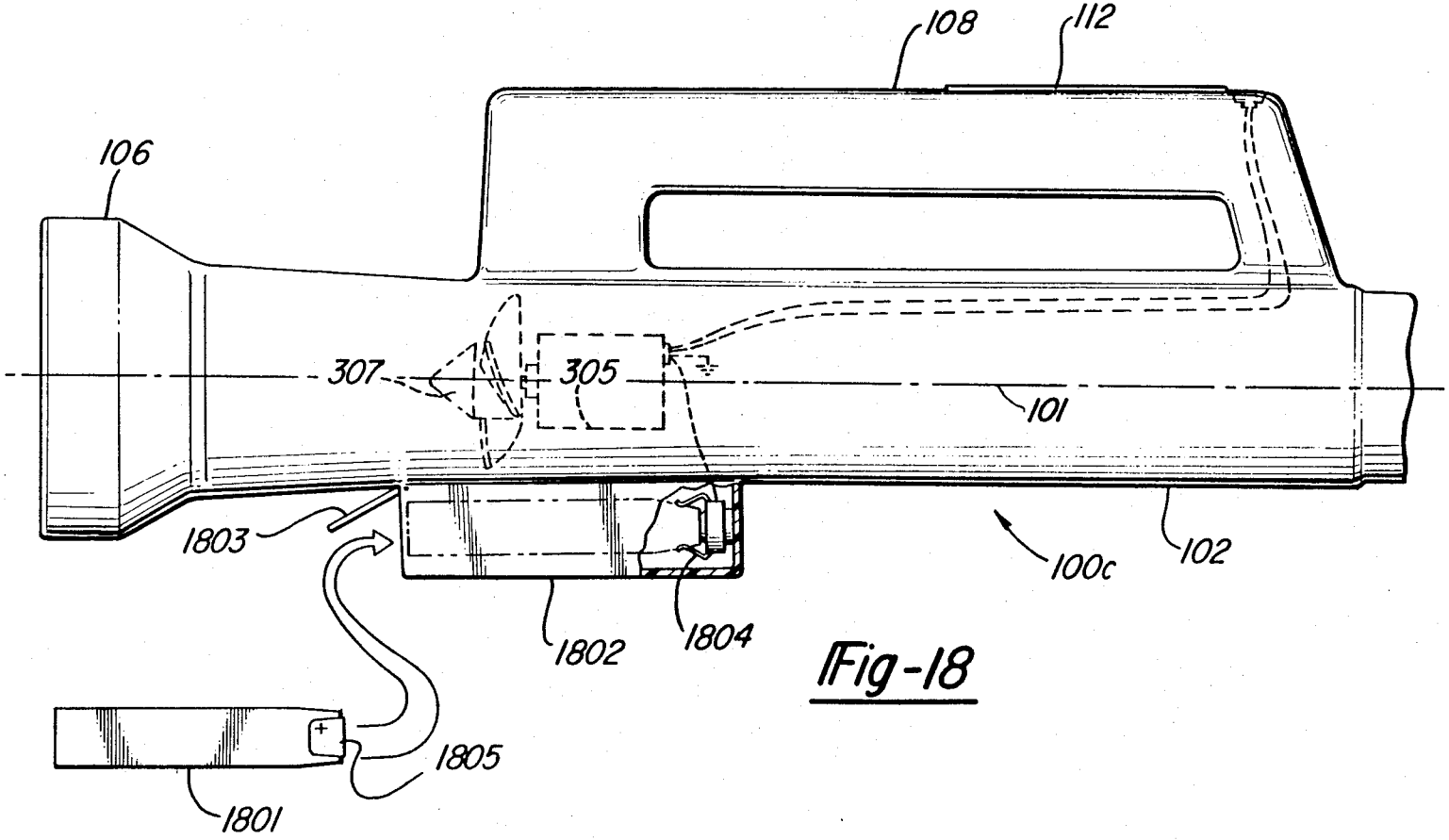
Figure 19:
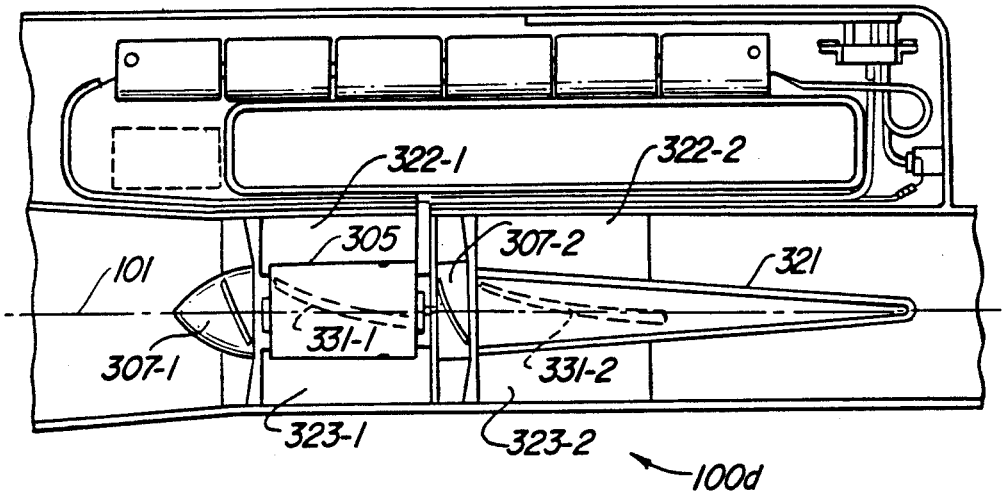
Figure 20:
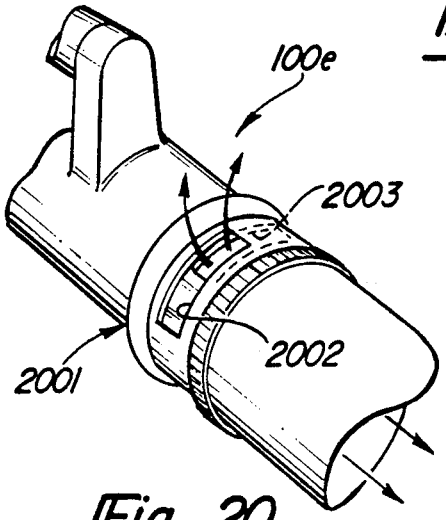
Figure 21:
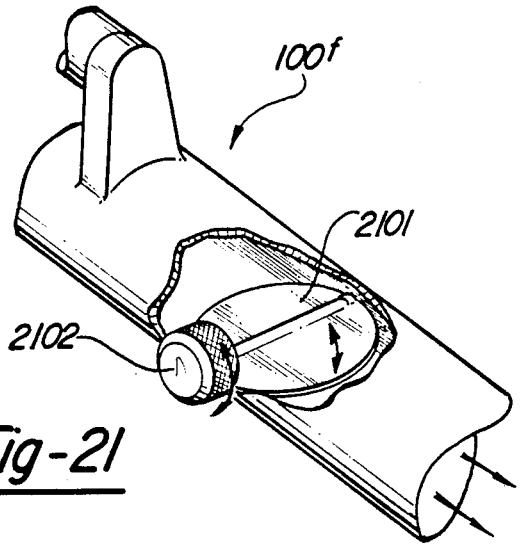

FIG. **14*a* and 14*b*** are side and top views, respectively, of an air straightening vane as it cooperates with a drive motor, the straightening vane being formed with or coupled to the blower housing wall;

FIG. 15 is a diagrammatical view depicting airflow vectors into and out of a blower fan as such vectors relate to the cross-section of a straightening vane of the blower of the invention;

FIG. 16 is a side cross-sectional view of a first alternative embodiment wherein a separate handle is eliminated and the batteries for the blower are housed within a streamlining structure abutting the drive motor;

FIG. 17 is a perspective view of a second alternative embodiment having no separate handle and a special battery compartment integral with the housing yet maintaining the batteries clear of the generated airflow;

FIG. 18 is a side plan view of a third alternative embodiment employing a detachable, rechargeable battery pack for use with the blower assembly designed in accordance with the principles of the invention;

FIG. 19 is a side cross-sectional view of a fourth alternative embodiment utilizing two tandem blower fans in a blower assembly designed in accordance with the principles of the invention;

FIG. 20 is a perspective view of a fifth alternative embodiment employing an adjustable collar apparatus for varying the airflow rate of a blower assembly designed in accordance with the principles of the invention; and FIG. 21 is a partially cut-away perspective view of a sixth alternative embodiment employing an adjustable butterfly valve apparatus for varying the airflow rate of a blower assembly designed in accordance with the principles of the invention.

DETAILED DESCRIPTION

Figure 1:
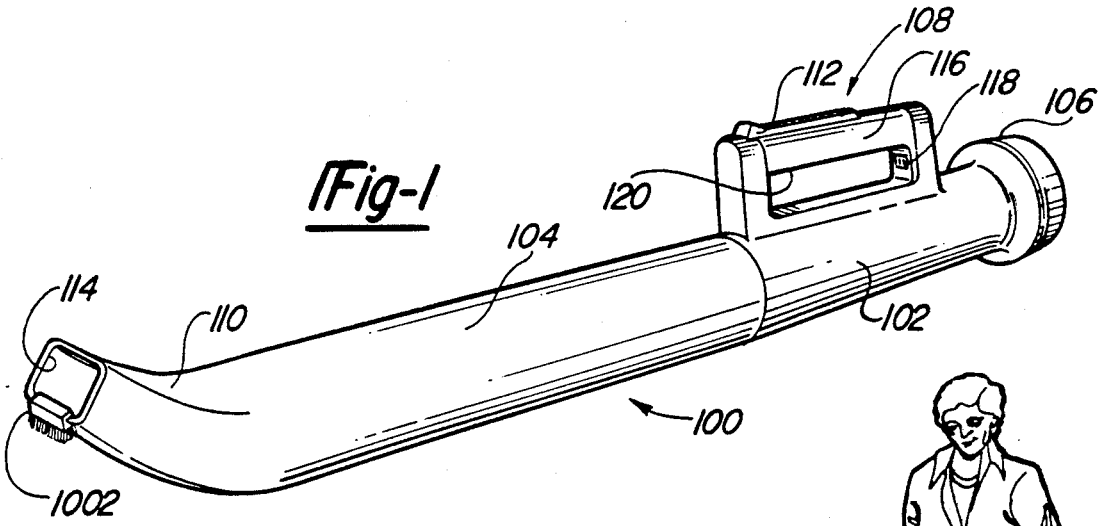
FIG. 1 is a perspective view of a preferred embodiment of a hand-held, cordless blower assembly arranged in accordance with the principles of the invention.

A preferred embodiment of a portable blower designed in accordance with the principles of invention is set forth in the perspective view of FIG. 1. Blower 100 has an elongate tubular housing comprised of a drive motor and fan housing portion 102 and an outlet or exhaust portion 104. Extending from housing portion 102 is a handle 108 providing a handle gripping portion 116 separated from the housing by an opening 120. At the outer surface of the handle grip portion 116 of handle 108 is an elongate sliding switch 112 used for applying power to the fan motor from a plurality of rechargeable batteries housed within the handle (not shown in this view but to be discussed below with reference to FIG. 3). The exhaust portion of the housing 104 is detachably coupled to housing portion 102 and is preferably angled as at 100 to provide an outlet nozzle opening 114. An optional brush attachment 1002 is mounted to the undersurface of the outlet nozzle. At the inlet end of the housing is a guard member 106 which is coupled to an enlarged inlet end of the housing for purposes to be discussed below. Finally, a jack 118 is provided in the handle portion of the housing for attachment to a source of charging energy for the rechargeable batteries used with the device in the preferred embodiment.

Figure 2:
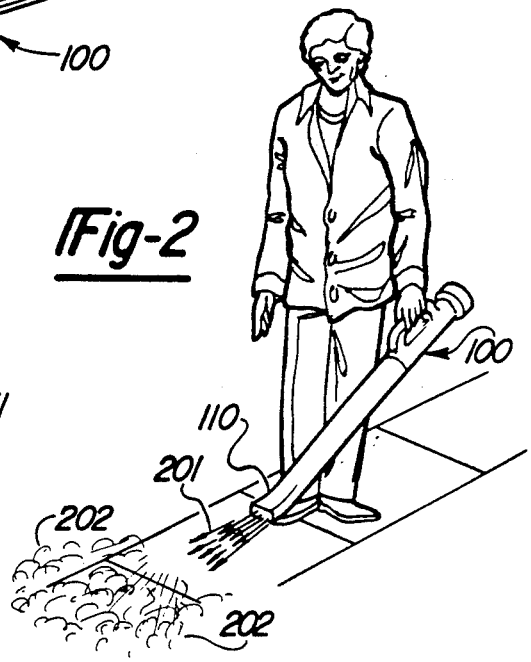
FIG. 2 is a view demonstrating the use of the blower of FIG. 1.
Figure 4:
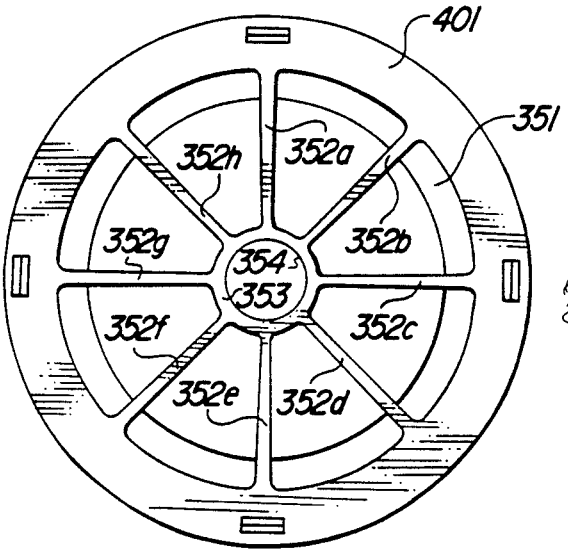
FIG. 4 is a view from the inlet end of the blower housing taken along line 4—4 of FIG. 3.

FIG. 2 depicts the manner in which the blower of FIG. 1 would be typically used for clearing debris such as grass clippings 202 from a sidewalk 201. The elongated actuator switch 112 of handle 108 enables the operator to grasp the handle at various positions to obtain a desired balance, yet enables easy on-off actuation of the blower motor without the necessity of shifting the user's hand position on the handle grip 116. Therefore, the blower is easily used by individuals of varying heights. The arrangement of the handle requires the user, as shown in FIG. 2, to point the blower at the desired work surface as a natural extension of the user's arm. Locating the batteries in the handle avoids the "pendulum effect" weight problem common with many portable devices and enables maintenance of a stable operating position of the blower outlet nozzle while the blower assembly is in use.

Figure 3:
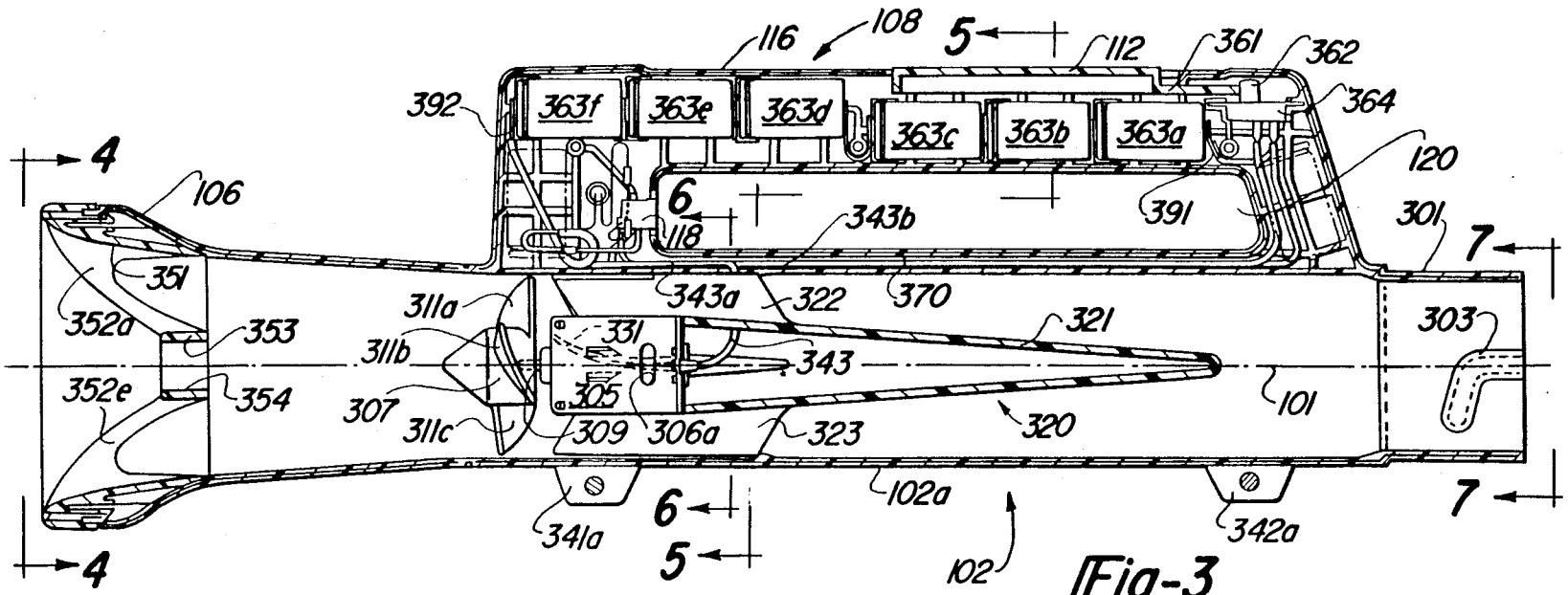
FIG. 3 is a side cross-sectional view of the blower housing portion of the assembly of FIG. 1.
Figure 7:
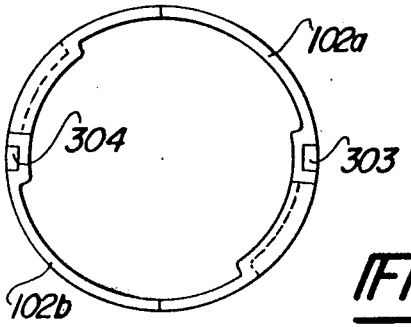
FIG. 7 is a view from the blower housing end opposite the inlet end taken along line 7—7 of FIG. 3.
Figure 6:
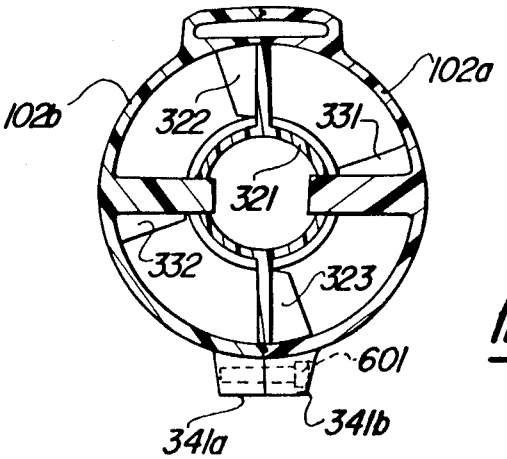
FIG. 6 is a view along the axis of the blower housing taken along line 6—6 of FIG. 3.
Figure 8:
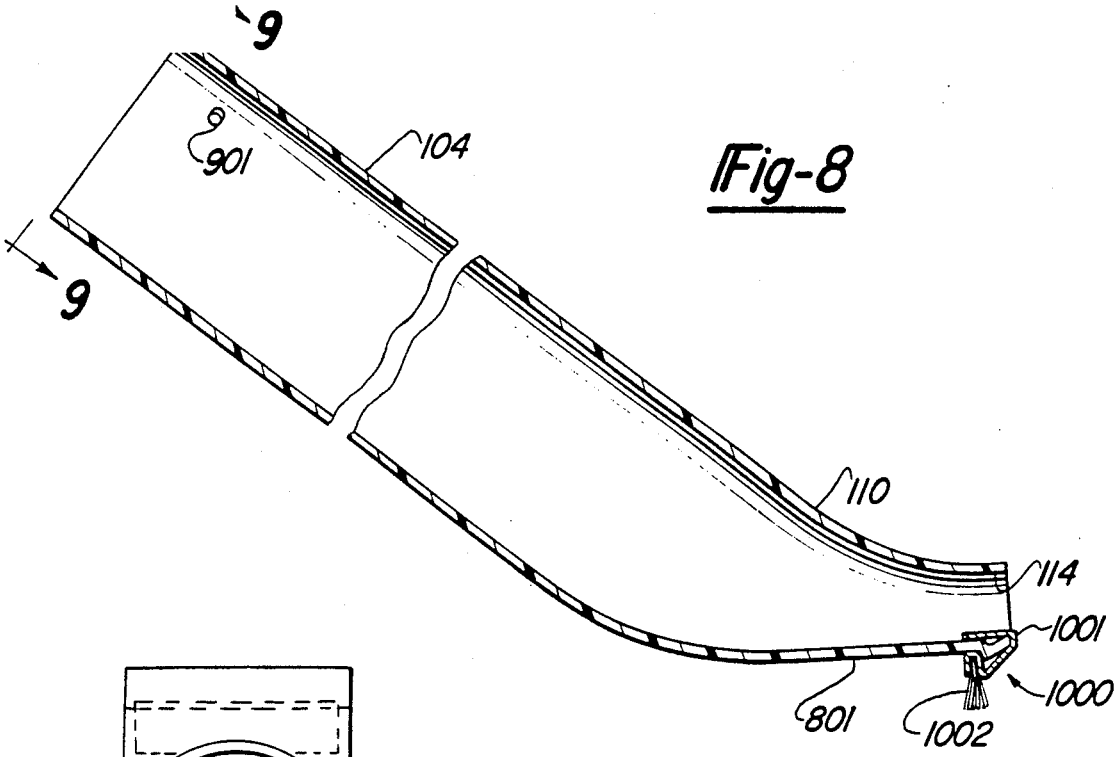
FIG. 8 is a side cross-sectional view of the exhaust tube portion of the assembly of FIG. 1.
Figure 9:
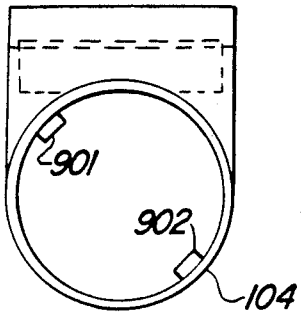
FIG. 9 is a view of the coupling end of the exhaust tube taken along line 9—9 of FIG. 8.

Further details of the structure and function of the drive motor fan and carrying handle are best given in conjunction with FIGS. 3 through 7. In the views of FIGS. 3 through 7, like components are given the same designations in the various views. Housing portion 102 is fashioned in two half pieces **102*a* and 102*b*, the respective halves fashioned, for example, by injection molding, being coupled together using screws such as at 601 (FIG. 6) engaging screw boss portions 341*b* and 341*a*. In FIG. 3, two locations for the screw bosses extending from an exterior housing wall are shown at 341*a* and 342*a*. Housing portion 102*a* has a decreased diameter as at 301 for receipt over an outer surface thereof of an end of the exhaust nozzle portion 104 (FIG. 1). The nozzle portion 104 is detachably coupled to housing portion 102 via lugs engaging openings 303 and 304 in the wall of housing portion 102. The openings extend horizontally for a short distance and then slant circumferentially such that the exhaust nozzle may be slipped on to portion 301 of housing 102 and then twisted so as to lock it into position. As seen best from FIG. 7, each half of housing 102—i.e., 102*a* and 102*b*—carries one of the coupling openings 303 and 304**, respectively.

At the inlet end of the tubular housing portion 102 is placed a guard member 106 having a generally increased diameter over that of th midsection of the tubular housing in the area of a drive motor 305 and fan assembly 307. Guard member 106 includes a slightly flared portion 351 extending from the tubular housing portion to the inlet aperture itself. Additionally, the guard member includes a plurality of arcuate ribs **352*a* through 352*h* as seen from FIGS. 3 and 4. Ribs 352 extend from the flared surface portion 351 of the housing at an outer annular section of a guard face 401 inwardly to an annular member 353 defining a smaller substantially circular inlet area 354 located centrally of the housing tube. As seen from FIG. 4, guard end member 401 and radially extending ribs 352*a–h*** serve to prevent a user from inserting his hand into the inlet end of the housing and contacting the blower fan.

As seen from FIG. 3, disposed substantially centrally of the housing portion 102 is a drive motor 305 having a drive shaft 309 which extends substantially coaxially with the longitudinal axis 101 of the housing tube. Drive motor 305 in the preferred embodiment comprises a DC permanent magnet motor. Coupled to the drive shaft 309 is an axially directed fan 307 having three glades **311*a, b, c*, for directing air to the right as seen in FIG. 3 towards the outlet nozzle of the blower assembly. Abutting motor 305 at an end remote from the fan 307 is a streamlining member 320 comprised of a substantially conical extension 321** having a cone base abutting the end of the motor and a cone apex directed toward the outlet nozzle.

Radially spaced around motor 305 are four air directing vanes 322, 323, 331 and 332. Each air directing vane is curved at its end closest to fan 307, as seen in the edge view of vane 331 of FIG. 3, such that air exiting the fan blades is smoothly directed along the vane. In this manner, the airflow from the fan is directed in a direction substantially parallel to the longitudinal axis 101 of the housing with minimal radial or swirling components. Straightening vanes 322 and 323 are coupled to, or are integrally formed with, streamlining member 320, while straightening vanes 331 and 332 are coupled to, or alternatively integrally formed with, an inner wall of housing portion 102. As seen from FIG. 6, for example, van 331 extends from housing wall portion **102*a* while vane 332 extends from housing wall portion 102*b*. Tab portions on vanes 331 and 332 engage air cooling apertures or ports in motor 305, one of which is shown at 306*a* i FIG. 3. (The details of the engagement of such tabs with the apertures on the motor will be discussed in a later section of this description.) Hence, motor 305 is radially supported by portions of vanes 322, 323, 331 and 332 at a preselected position within blower housing 102 concentric with the logitudinal axis 101 of the housing as noted above. Additionally, motor 305 is thereby substantially fixed against axial and rotational movement relative to the blower housing by the engagement of the ports, such as 306*a*, with the tab portions of the straightening vanes which are coupled to, or are integral with, the housing wall 102*a* or 102*b***.

Figure 5:
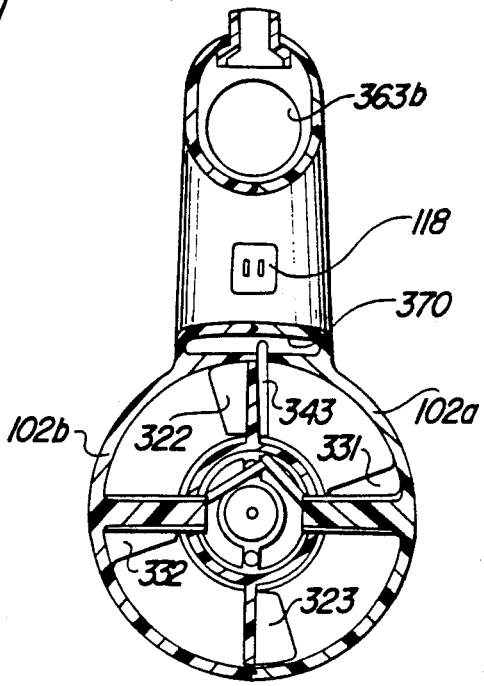
FIG. 5 is a view along the axis of the housing blower taken along line 5—5 of FIG. 3.

With continued reference to FIG. 3 and FIG. 5, housing portion 102 includes a handle portion 108 extending from an outer portion of housing wall 102 and defining a handle grip portion 116 separated from housing portion 102*a* via an opening 120. Within the gripping portion 116 of handle 108 is a storage compartment for a plurality of rechargeable DC energy cells or batteries six of which are shown in the view of FIG. 3 and designated 363*a* through 363*f*. Extending above an upper surface of the handle grip portion is an elongated switch actuator 112 having an end portion 361 within handle member 108 which is coupled to a movable element 362 of electrical switch 364. Switch 364 is operable in a conventional manner to place the plurality of batteries 363*a–f* in circuit with motor 305 for actuation thereof. The plurality of batteries is placed between two terminals 391 and 392 which are appropriately connected to the electrical circuitry of the blower in a conventional manner. Drive motor 305 is electrically connected to the battery array and switch 364 via lead wires 343 and 343*a* and 343*b* which are contained within a cavity 370 formed between an outer wall of the housing tube 102 and the handle element 108.

Additionally in handle member 108 is a female jack element 118 for providing access from the battery array to a source of electrical charging energy. Preferably, the jack 118 is located in a protected location on an interior surface of the handle 108 as shown.

To enhance the airflow characteristics of the blower, the inlet nozzle and guard at 106 are designed so as to minimize the pressure drop normally associated with the acceleration of air being drawn into the blower housing by fan 307 around the inlet guard. Air drawn into a substantially cylindrical duct such as provided by housing portion 102 tends to swirl at the inlet resulting in a reduced effective inlet area and an increased pressure drop across the inlet aperture. To avoid such losses, a radiused flange such as at 351 is placed between the inlet opening and the conduit formed by the housing wall 102. Additionally, as the inlet guard will necessarily occupy or block some of the opened inlet port area, it is desirable to locate the guard at the enlarged inlet portion of the housing tube. In this manner, the net open area at the guard (between the ribs 352 and the walls of the annular member 353) can be made at least as large as the cross-sectional area of the blower housing duct at the fan to minimize the losses associated with the disruption of the air around the guard as it enters the blower housing. Alternatively, the motor and fan assembly may be located a greater distance away from the inlet to the housing (subject to the noise reduction considerations discussed below) and the guard assembly reduced to a single diametric rib or eliminated altogether. Such a construction would reduce the degree to which the inlet would need to be enlarged in order to insure a smooth flow of air into the tubular housing.

With reference to FIGS. 7 through 10, the outlet or exhaust nozzle portion 104 of the blower assembly of FIG. 1 will be described in more detail. Exhaust nozzle 104 has an outlet port 114 which in the preferred embodiment is substantially rectangular in cross-section. Other outlet port configurations, however, may be used. Exhaust nozzle 104 is detachably coupled to housing portion 102 by sliding the end portion containing lugs 901 and 902 over the decreased diameter housing portion 301 of housing portion 102 such that lugs 901 and 902 will respectively enter curved slots 303 and 304 formed in section 301 of housing portion 102. After insertion of the lugs into the slots, the exhaust nozzle 104 is then rotated to lock he connection in place. The portion of nozzle 104 terminating in an outlet opening 114 is preferably angled at 110 with respect to the remainder of the outlet nozzle such that the air being expelled by the blower fan out of the blower assembly will exit substantially parallel to the surface to be cleared of debris. In this orientation, undersurface 801 of the exhaust nozzle faces the work surface and may be provided with a brush 1002 detachably coupled to the exhaust nozzle via a spring clip 1001.

Figure 10:
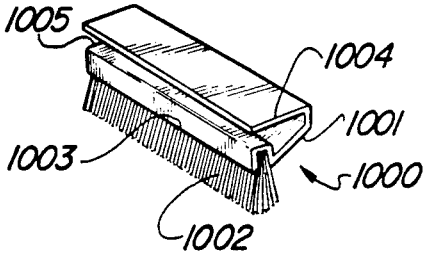
FIG. 10 is a perspective view of an optional brush attachment coupled to the exhaust nozzle of the exhaust tube of FIG. 8.

The brush-spring assembly 1000 as set forth in the perspective view of FIG. 10 is seen to comprise the brush bristles 1002 retained in a U-shaped portion of the spring clip 1001, the U-shaped channel being designated 1003. The spring clip has an upper surface 1004 which defines an opening 1005 between the brush-holding channel 1003 and the upper portion of the clip 1004. As seen from FIG. 8, the clip forced over an end lip of the outlet port 114 along bottom surface 801 of exhaust tube 104 to clamp the brush in operative position.

While the size of the housing tube portion containing the fan is dictated by the fan diameter, the size of the outlet port 114 at the end of the output nozzle 104 can be chosen from a wide variety of sizes. A large diameter outlet will cause little resistance to airflow and therefore produce a high airflow volume rate. However, because the area would be large, the air velocity would be low. Likewise, a smaller diameter outlet will result in a lower air volume rate but an increased velocity. Hence, the nozzle outlet area is optimally varied until a satisfactory blend of volumetric air flow and air velocity is attained.

The angle that the exhaust tube housing portion 104 makes with its terminal end at 110 in the preferred embodiment is determined by the overall blower tube length, handle location, operator height and the desirability for air discharge parallel to the work surface. It is contemplated that the present portable blower will normally be used by moving the outlet nozzle back and fourth near a horizontal work surface such as the ground. Occasionally, the outlet nozzle may also be used to dislodge stubborn debris (either directly or through the use of the optional brush assembly attachment 1000 shown in FIGS. 8 and 10). In order to prevent the outlet nozzle from wearing through and to improve scraping performance, the bottom of the outlet nozzle at 801 has been flattened and widened while maintaining the required outlet area. This results in the substantially rectangular outlet opening shown at 114. The flattened bottom 801 also enables a more facile attachment of the brush assembly 1000 particularly for dislodging small debris from rough surfaces (for example, for removal of sand from a driveway).

Figure 11:
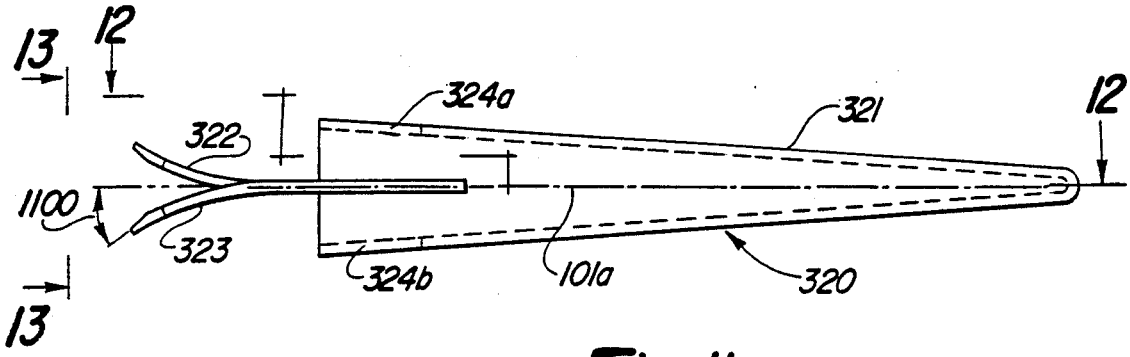
FIG. 11 is a side view of the blower motor support for the blower assembly set forth in FIG. 3.
Figure 12:
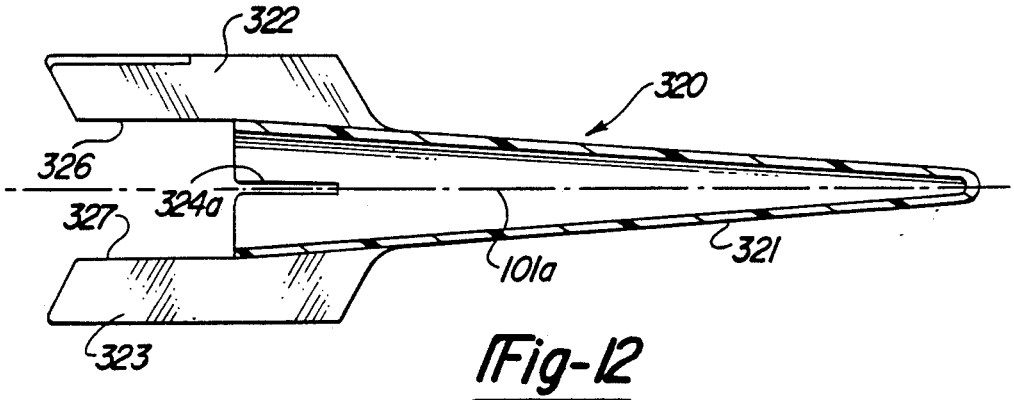
FIG. 12 is a cross-sectional view of the blower motor support taken along line 12—12 of FIG. 11f
Figure 13:
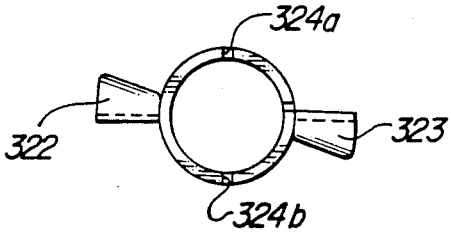
FIG. 13 is an end view of the blower motor support taken along line 13—13 of FIG. 11.

Referring to FIGS. 11–15, the combined motor support and airflow smoothing and guiding apparatus will now be explained. With particular reference to FIGS. 11 through 13, the streamlining element 320 has a conical surface 321 extending from a base which abuts an end of motor 305 (FIG. 3) and extends at a preselected taper angle to a cone apex facing the exhaust nozzle portion of the blower assembly. Coupled to or integrally formed with the streamlining cone portion 321 are a pair of substantially axially extending air straightening and guiding vanes 322 and 323 extending diametrically opposite from one another from the surface of the cone element. As seen from FIG. 11, an end portion of each vane furthest from the conical element makes an angle designated 1100 with the longitudinal axis 101*a* of the conical portion 320 (which is substantially coaxial to the longitudinal axis 101 of the blower housing tube of FIG. 3). These end portions are angled such that air exiting the fan will be efficiently redirected in a direction substantially parallel to the axis of the blower housing tube. Two slots 324a and 324b are formed diametrically opposite one another in the surface of the conical portion 321 and are positioned so as to receive a portion of two other air guide vanes which extend from the housing wall.

Figure 14A:
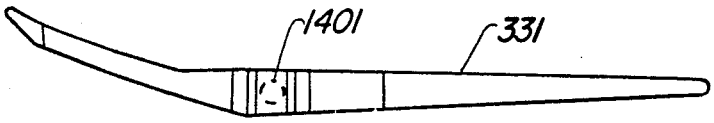

The two guide vanes extending from the housing wall are best described with reference to FIGS. 14a and 14b. FIG. 14a sets forth a side view of air guide vane 331 which is shown principally in phantom in the view of FIG. 3. The portion of vane 331 closest to the fan is, like the vanes 322 and 323 of FIG. 11, angled with respect to the air exiting the fan so as to enable efficient smoothing and redirecting of the exiting air stream. It is to be understood that the second guide vane extending from the other half of the housing portion 102, designated in FIG. 14b as 332 when veiwed in side section will have a portion nearest the fan which extends at an angle opposite to that shown for vane 331 in FIG. 14a. Hence, vanes 331 and 332 serve a similar purpose to vanes 322 and 323 of FIG. 11, except that vanes 331 and 332 are positioned in different quadrants of the cross-section of the tubular housing with respect to the outlet of the fan.

With particular reference to FIG. 15, the manner in which the vanes straighten the airflow from the fan will now be explained. As seen from FIG. 15, the air entering the fan has a vector component V1 parallel to the longitudinal axis 101 of the blower housing. The fan blade has a tangential velocity component U1. The relative velocity of the air with respect to the blade is represented by the vector W1. the air exiting from the blade 1501 has a non-axially directed major component vector V2 along with tangential components U2 and relative velocity component W2. The straightening vane 1502 provides an end portion 1504 which lies substantially parallel to the direction of airflow 1503 as it exits fan blade 1501 (i.e., parallel to vector $V_2$). The air leaving the fan has a rotational velocity component as shown by the difference in the absolute velocity vectors V1 into the fan and V2 out of the fan. The difference between V2 and V1 is related to the amount of energy put into turning the fan and the mass flow rate of air flowing through the fan. Without straightening vanes shaped such as vane 1502, the air would spin down the lower housing tube wasting the kinetic energy added by the fan ($\frac{1}{2}m(V_2^2-V_1^2)$). With a straightening vane such as 1502, the air is redirected to flow axially down the tube at velocity V1. Because the airflow velocities before and beyond the fan are substantially equal, the further because the tangential component of the airflow has been removed, the fan thereby adds pressure to the airflow. In effect, the tangential air component has been converted to increased pressure. This added static pressure thus results in higher exit velocity out of the tube outlet 114 than would be possible without the straightening vanes.

Figure 14B:
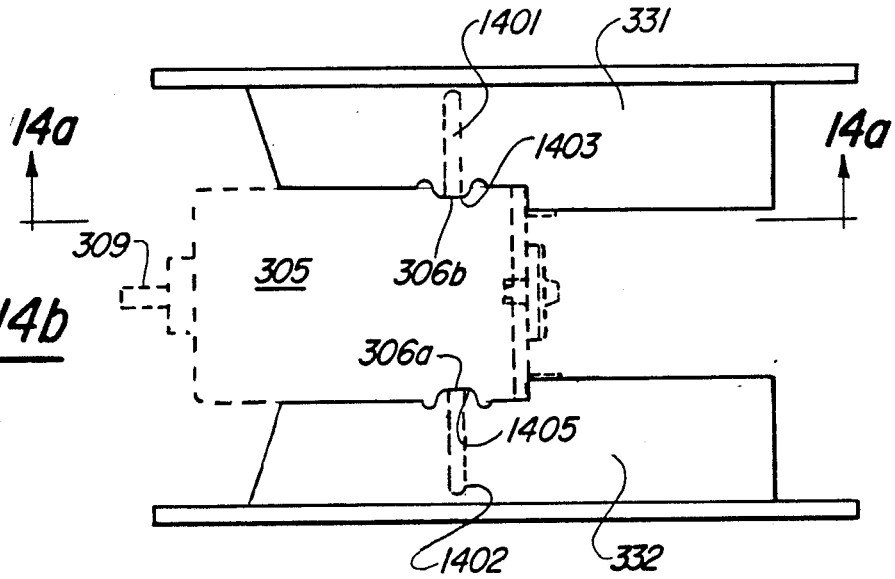

As seen from FIG. 14b, vanes 331 and 332 serve the additional purpose of positioning the motor 305 and fixing it against axial and rotational movement relative to the housing. In particular, vane 331 and 332 are provided with respective tab sections 1403 and 1405 which engage cooling ports or apertures 306b and 306a, respectively, in an outer surface of motor 305. Additionally, vanes 331 and 332 bear against a second solid portion of the housing of motor 305 for further stability in supporting the motor-fan assembly. As an optional arrangement for the vane supporting structure set forth in FIG. 14b, each tab portion may have a hole (1401 for tab 1403, or 1402 for tab 1405) formed in the tab portion for receipt of a support member such as a steel pin to provide added resistance to fracture or shearing of the tab members extending from the guide vanes.

The tail cone or streamlining element 320 shown in FIGS. 3, 11 and 12 allows the air to gently expand from an annular airflow passage about motor 305 downstream of the fan without excessive separation to a more fully circular air passage towards the outlet nozzle, thereby reducing the drag on the motor. Hence, the loss of pressure as the air leaves the motor is minimized, resulting in higher airflow for a given amount of energy put into the fan by the drive motor. The preferred slope of the conical surface 321 from the motor towards the outlet end is on the order of 7 degrees.

The four air straightening vanes 322, 323, 331 and 332, with two vanes depending from the housing and two from the streamlining cone, support drive motor 305 at a preselected position within the housing. As previously noted, the motor 305 is oriented so that the axis of the motor is aligned with the longitudinal axis 101 of the housing 102, thereby enhancing airflow past the motor. In addition, it should also be noted that the blower housing itself is more easily fashioned, for example by injection molding, with the arrangement wherein two of the vanes are coupled to the streamlining cone, while one vane is integral with or coupled to each half of the housing body 102a or 102b.

The present invention additionally contemplates arrangements for abating noise and vibration of the blower while the fan is operating. With reference to FIG. 3, as each fan blade 311a, *b*, *c* passes one of the four vanes 322, 323, 331, or 332, it is unloaded and reloaded thereby causing a pulsation in the thrust of the fan. If all the blades do this simultaneously, the vibration and sound at a frequency of four times the rotational speed of the fan could be excessive. To avoid this problem, the number of fan blades should be unequal to the number of air directing stationary vanes. Hence, for the embodiment set forth in FIG. 3, there are three fan blades and four stationary air guide vanes. Because the blower of the invention is particularly suited to applications requiring lower static pressure, it is also preferable that the solidity of the fan (i.e., the percentage of the area of the housing duct occupied by the projected area of the fan blades) be low. Hence, for a given solidity and desired blade angle, a three-bladed fan as set forth at 307 of FIG. 3 is used in the embodiment disclosed.

Another consideration for noise abatement in practicing the invention relates to the positioning of the fan relative to the inlet port of the tubular blower housing. Sound generated by fans usually has predominant frequencies (with corresponding predominant wave lengths), one of which is equal to the rotational speed of the fan multiplied by the number of fan blades. This predominant frequency is called the "blade-pass-frequency." When sound waves are generated in open ended tubes such as the blower housing of the embodiment of FIG. 1, waves of certain frequencies resonate in the tube. Such waves are referred to as standing waves and have nodes at the end of the tube. However, standing waves, like those of an organ pipe, can only exist if the wave length of the sound is such that a pressure node (low pressure) is present at the end of the blower housing duct. Under such a condition, the wave will be reflected back into the duct by the higher pressure just beyond the end of and outside of the duct. The duct will thus resonate at the standing wave frequency.

Accordingly, by positioning the source of the noise, in this case the fan, at a distance from the end of the tube equal to one-quarter of the wave length of the predominant frequency, the intensity of the noise at that frequency can be greatly reduced. Of course, it will be recognized by those skilled in the art that the one-quarter wave length spacing consideration theoretically applies only to the ideal case. The noise generated by the fan in a practical device such as that set forth with reference to FIGS. 1 through **14*b*, has predominant frequencies that depend on the number of fan blades, the number of air guide vanes, and the rotational speed of the fan. By carefully adjusting the distance between the inlet port at guard 106** and the fan, the predominant frequencies can be abated by preventing standing waves of the wave lengths corresponding to those predominant frequencies.

Since, as described above, the duct is not perfectly cylindrical from one end to the other, the preferred location of the fan can be determined most readily using a spectrometer to define the location of standing wave nodes for various frequencies generated by the fan. In any event, the invention contemplates locating the fan at a distance from the inlet port at guard 106 that will inhibit the generation of standing waves of predominant frequencies, thereby rendering the operation of the blower of the invention relatively quiet and vibrationless.

Several alternative arrangements contemplated by the invention will now be briefly described with reference to FIGS. 16 through 21.

FIG. 16 depicts a first alternative embodiment in a cross-sectional view similar to FIG. 3. In this alternative arrangement, rather than providing a separate handle grip extending from outside the air duct formed by the housing wall, blower **100*a* is held by gripping the main body housing 102. The batteries 363-1 through 363-6 are stored in the main body housing within the conical element 320 used for streamlining purposes adjacent to motor 305. The battery array is therefore located coaxially with the longitudinal axis 101 of the blower housing. The air straightening vane and support system for the motor 305 is otherwise substantially identical to that described with reference to the preferred embodiment of FIG. 1**, except that it also serves to support and align the battery array.

FIG. 17 depicts, in perspective form, a second alternative embodiment wherein a shoulder strap 1705 is provided for carrying the blower **100*b*. Alternatively, the blower 100*b* could be grasped at section 1701 which houses the fan motor and support vane arrangement similar to that described with reference to the preferred embodiment. Exhaust tube 1702 would be similar to that previously described. Inlet 1704 would be provided with a guard arrangement (not specifically shown) which is similar to that described with reference to the preferred embodiment. In the embodiment of FIG. 17 however, the batteries would be housed in an integral compartment 1703** of the housing such that the batteries would lie outside of the main air stream being drawn into the blower housing by the fan and motor.

A third alternative embodiment is set forth in the partial side plan view of FIG. 18. Housing **100*c* utilizes a separate rechargeable battery pack 1801 having terminals at 1805 for engaging a spring loaded terminal 1804 within a specially provided compartment 1802 in the housing of blower 100*c*. A hinged access door 1803 swings up to permit insertion of battery pack 1801 into the compartment 1802 for engagement with spring loaded terminal 1804. As shown by the dotted lines in FIG. 18, the battery pack is cabled to the motor and to an elongate switch 112 provided in handle 108 for proper feed of energy to the drive motor 305 whenever the actuating switch 112 is set to a predetermined ON position. When the battery pack 1801 needs recharging, it can be removed from housing compartment 1802** and attached to a suitable source of recharging energy.

FIG. 19 depicts a side cross-sectional view of part of a fourth alternative embodiment of a portable blower designed in accordance with the principles of the invention wherein a tandem arrangement of more than one, for example two, blower fans is utilized for providing increased air output. As seen from FIG. 19, blower fans 307-1 and 307-2 are mounted to opposite ends of a drive shaft driven by motor 305. Downstream of the second fan 307-2 is a conical streamlining device 321. Also used with the blower housing **100*d* of this embodiment are air straightening vanes 322-1, 323-1 and 331-1 surrounding motor 305 and vanes 322-2, 323-2, and 331-2 surrounding streamlining cone 321 immediately downstream of the second fan 307-2. It will be apparent of course that a fourth vane for each fan corresponding respectively to vanes 331-1 and 331-2 extends along the exiting air path for each fan but is not shown in the view of FIG. 19**.

The invention additionally contemplates providing apparatus for enabling adjustment of the blower airflow rate. Two such arrangements are shown in the alternative embodiments of FIGS. 20 and 21.

In a fifth alternative embodiment set forth in the partial perspective view of FIG. 20, variable airflow adjustment is made possible by providing an aperture 2003 in the tubular housing wall of blower **100*e*. Mounted for rotation about the tubular housing directly over the aperture 2003 is a rotatable collar 2001 having an apertured portion 2002 while the remainder of the collar is solid. Hence, by suitably rotating collar 2001 it will be seen that all or a portion of aperture 2003 in housing wall 100*e* will be exposed via the apertured portion 2002** of the collar, thereby enabling a preselected amount of airflow to be diverted out of the side of the housing to thereby alter the airflow which will ultimately exit the exhaust port.

A second approach to providing adjustable airflow rates is set forth in a sixth alternative embodiment in the partial perspective view of FIG. 21 wherein a butterfly valve 2101 is pivotally mounted within the air conduit defined by the housing body of a blower **100*f*. Coupled to the butterfly valve 2101 is an adjustment knob 2102 which is mounted exteriorly of the blower housing for manual adjustment of the position of the butterfly valve 2101 with respect to the airflow being directed outwardly toward the exhaust port. Hence, in a manner similar to that seen in venturi chambers, such as found in carburetors, the butterfly valve 2101** will alter the airflow rate in accordance with its relative position within the blower housing tube.

It will be apparent to those of ordinary skill in the art, given the disclosure of this detailed description, that there will be yet further alternative arrangements still falling within the contemplation of the invention. For example, variations in the airflow rate could be provided by utilizing a variable speed electric motor for driving the fan and the blower. Also, it will be seen that a variety of accessories could be provided with a blower unit designed in accordance with the principles of the invention, such accessories including various nozzles having different types of scrapers, brushes or other apparatus for dislodging objects that are heavy or struck to the work surface to be cleaned by the blower. In a still further alternative arrangement, it may be desired to provide for the ability to step up the performance of the blower by enabling the facile addition of more battery cells to the housing. In yet another alternative arrangement, it may be desirable to provide means for converting the blower unit to a vacuum cleaning device wherein a filter bag or other collection device would be placed on the suction side of the blower fan. In such an arrangement two switches could be used to allow the product to be used in either a blowing or vacuuming mode of operation.

The invention has been described with reference to a preferred embodiment and several alternative arrangements. Such detailed description has been given for the sake of example only. The scope and spirit of the invention are to be governed by the appended claims.

What is claimed is:

1. A hand-held portable, electrically driven blower adapted to be usable by users of varying heights, comprising:

an elongated tubular housing defining a longitudinal axis;

an electrical drive motor mounted to said housing and having a drive shaft;

fan means coupled to the drive shaft of said motor and having a plurality of fan blades for moving air through said tubular housing;

an elongated handle connected to said tubular housing and adapted to be grasped by the hand of the user at various positions along the length of said handle so that the tubular housing of the blower is suspended from the handle when in use; and switch means including an electrical switch electrically connected to said drive motor for controlling the application of electrical energy to said drive motor and elongated actuator means connected to said electrical switch for controlling the position of said switch, said elongated actuator means being located in said handle and actuable by the hand of the user when grasping said handle at any of said various positions on said handle.

2. The portable electric blower according to claim 1 further including an inlet portion connected to one end of said tubular housing and an outlet portion connected to the other end of said tubular housing, and wherein said elongated handle is connected to said tubular housing intermediate said inlet and outlet portions.

3. The portable electric blower according to claim 2, said electrical drive motor is mounted within said tubular housing intermediate said inlet and outlet portions so that said drive shaft is substantially aligned with said longitudinal axis of said tubular housing, and said fan means rotates about said longitudinal axis for moving air from said inlet portion to said outlet portion.

4. The portable electric blower according to claim 1 wherein said elongated handle extends substantially parallel to said longitudinal axis of said tubular housing.

5. The portable electric blower according to claim 1 wherein said elongated actuator means is adapted to be slidable along an axis substantially parallel to said longitudinal axis of said tubular housing.

6. The portable electric blower according to claim 1 further including at least one DC energy cell located within said elongated handle and electrically coupled through said switch means to said electrical drive motor for furnishing electrical energy thereto.

7. A hand-held portable, electrically driven blower adapted to be usable by users of varying heights for blowing debris from sidewalks, driveways, decks, and other such surfaces, comprising:

an elongated tubular housing defining a longitudinal axis and having sufficient length to extend proximate to the surface on which a user is standing when holding the blower;

an electrical drive motor mounted to said housing and having a drive shaft;

fan means coupled to the drive shaft of said motor and having a plurality of fan blades for moving air through said tubular housing;

an elongated handle connected to said tubular housing and adapted to be grasped by the hand of the user at various positions along the length of said handle so that in the normal operating position of the blower the tubular housing of the blower is suspended from the handle when in use; and switch means including an electrical switch electrically connected to said drive motor for controlling the application of electrical energy to said drive motor and elongated actuator means connected to said electrical switch for controlling the position of said switch, said elongated actuator means being located in said handle and actuable by the hand of the user when grasping said handle at any of said various positions on said handle.

8. The portable electric blower according to claim 7 further including an inlet portion connected to one end of said tubular housing and an outlet portion connected to the other end of said tubular housing, and wherein said elongated handle is connected to said tubular housing intermediate said inlet and outlet portions.

9. The portable electric blower according to claim 8, said electrical drive motor is mounted within said tubular housing intermediate said inlet and outlet portions so that said drive shaft is substantially aligned with said longitudinal axis of said tubular housing, and said fan means rotates about said longitudinal axis for moving air from said inlet portion to said outlet portion.

10. The portable electric blower according to claim 7 wherein said elongated handle extends substantially parallel to said longitudinal axis of said tubular housing.

11. The portable electric blower according to claim 7 wherein said elongated actuator means is adapted to be slidable along an axis substantially parallel to said longitudinal axis of said tubular housing.

12. The portable electric blower according to claim 7 further including at least one DC energy cell located within said elongated handle and electrically coupled through said switch means to said electrical drive motor for furnishing electrical energy thereto.

13. A hand-held portable, electrically driven blower adapted to be usable by users of varying heights for blowing debris from sidewalks, driveways, decks, and other such surfaces, comprising:

an elongated tubular housing defining a longitudinal axis;

an inlet portion connected to one end of said tubular housing and an outlet portion connected to the other end of said tubular housing;

an electrical drive motor mounted within said tubular housing intermediate said inlet and outlet portions and having a drive shaft substantially aligned with said longitudinal axis;

fan means coupled to the drive shaft of said motor and having a plurality of fan blades for moving air through said tubular housing from said inlet portion to said outlet portion;

an elongated handle connected to said tubular housing and adapted to be grasped by the hand of the user at various positions along the length of said handle so that in the normal operating position of the blower the tubular housing of the blower is suspended from the handle when in use; said tubular housing having sufficient length so that said outlet portion is positioned proximate to the surface on which the user is standing when holding the blower by said handle; and switch means including an electrical switch electrically connected to said drive motor controlling the application of electrical energy to said drive motor and elongated actuator means connected to said electrical switch for controlling the position of said switch, said elongated actuator means being located in said handle and actuable by the hand of the user when grasping said handle at any of said various positions on said handle.

14. The portable electric blower according to claim 13 wherein said elongated handle is connected to said tubular housing intermediate said inlet and outlet portions.

15. The portable electric blower according to claim 13 wherein said elongated handle extends substantially parallel to said longitudinal axis of said tubular housing.

16. The portable electric blower according to claim 13 wherein said elongated actuator means is adapted to be slidable along an axis substantially parallel to said longitudinal axis of said tubular housing.

17. The portable electric blower according to claim 13 further including at least one DC energy cell located within said elongated handle and electrically coupled through said switch means to said electrical drive motor for furnishing electric energy thereto.

18. The portable electric blower according to claim 13 wherein said inlet portion is aligned with the longitudinal axis of said housing.

19. The portable electric blower according to claim 18 wherein said elongated tubular housing has a substantially uniform diameter along substantially its entire length.

20. The portable electric blower of claim 19 wherein said handle is connected to said tubular housing proximate to the location of said motor.

* * * * *

UNITED STATES PATENT AND TRADEMARK OFFICE

CERTIFICATE OF CORRECTION

PATENT NO. : 4,945,604

DATED : August 7, 1990

INVENTOR(S) : Jonathan L. Miner et al.

It is certified that error appears in the above-identified patent and that said Letters Patent is hereby corrected as shown below:

Title page, insert "Related U.S. Application Data", "Continuation of Ser. No. 119,491, Nov. 12, 1987, Pat. No. 4,884,314."

Column 14, line 16, claim 17, "electric" should be --electrical--.

Signed and Sealed this

Thirty-first Day of December, 1991

*Attest:*

HARRY F. MANBECK, JR.

*Attesting Officer*

*Commissioner of Patents and Trademarks*